US006945625B2

(12) United States Patent
Anderson

(10) Patent No.: US 6,945,625 B2
(45) Date of Patent: Sep. 20, 2005

(54) DETERMINING HUMIDITY OF FLUID-EJECTION MECHANISM BASED AT LEAST ON SPITTING RECOVERY LEVEL OF MECHANISM

(75) Inventor: Jeffrey J. Anderson, Ocean Park, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 154 days.

(21) Appl. No.: 10/615,737

(22) Filed: Jul. 9, 2003

(65) Prior Publication Data

US 2005/0007400 A1 Jan. 13, 2005

(51) Int. Cl.[7] ..... B41J 29/393; B41J 2/165

(52) U.S. Cl. ..... 347/19; 347/35

(58) Field of Search ..... 347/14, 19, 23, 347/35, 6; 73/29.02

(56) References Cited

U.S. PATENT DOCUMENTS 5,428,379 A * 6/1995 Kaneko et al. ..... 347/23
5,583,547 A * 12/1996 Gast et al. ..... 347/22
5,995,067 A * 11/1999 Terasawa et al. ..... 345/23
6,033,050 A * 3/2000 Morita et al. ..... 347/23
6,536,865 B2 * 3/2003 Sarmast ..... 347/23

* cited by examiner

*Primary Examiner*—Thinh Nguyen

(57) ABSTRACT

A method of an embodiment of the invention is disclosed in which a spitting recovery level of a fluid-ejection mechanism is determined. A humidity of the fluid-ejection mechanism is then determined, based on at least the spitting recovery level.

39 Claims, 5 Drawing Sheets

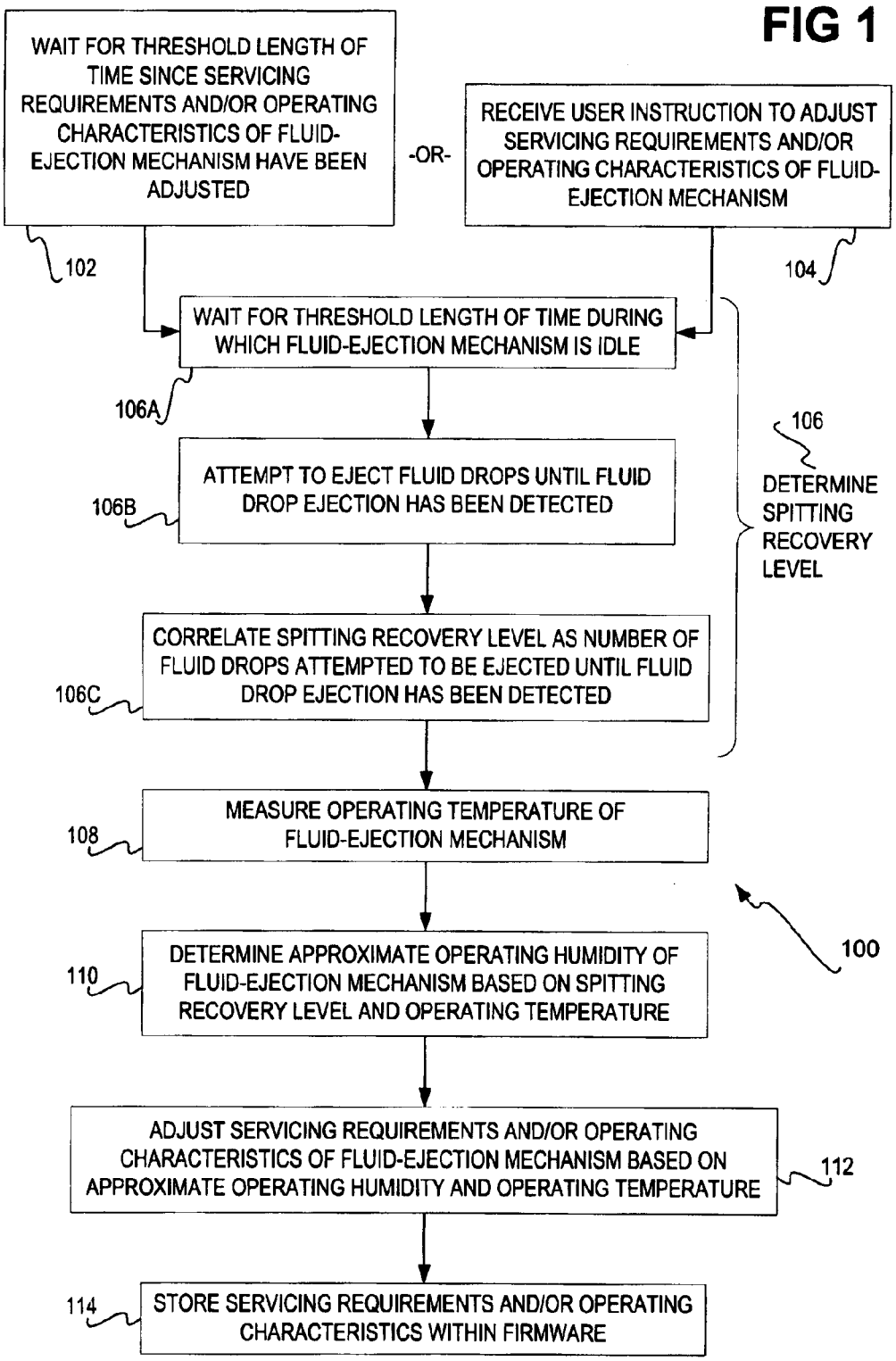
FIG 1
WAIT FOR THRESHOLD LENGTH OF TIME SINCE SERVICING REQUIREMENTS AND/OR OPERATING CHARACTERISTICS OF FLUID-EJECTION MECHANISM HAVE BEEN ADJUSTED
-OR-
RECEIVE USER INSTRUCTION TO ADJUST SERVICING REQUIREMENTS AND/OR OPERATING CHARACTERISTICS OF FLUID-EJECTION MECHANISM
102
104
WAIT FOR THRESHOLD LENGTH OF TIME DURING WHICH FLUID-EJECTION MECHANISM IS IDLE
106A
106
DETERMINE SPITTING RECOVERY LEVEL
ATTEMPT TO EJECT FLUID DROPS UNTIL FLUID DROP EJECTION HAS BEEN DETECTED
106B
CORRELATE SPITTING RECOVERY LEVEL AS NUMBER OF FLUID DROPS ATTEMPTED TO BE EJECTED UNTIL FLUID DROP EJECTION HAS BEEN DETECTED
106C
MEASURE OPERATING TEMPERATURE OF FLUID-EJECTION MECHANISM
108
100
DETERMINE APPROXIMATE OPERATING HUMIDITY OF FLUID-EJECTION MECHANISM BASED ON SPITTING RECOVERY LEVEL AND OPERATING TEMPERATURE
110
ADJUST SERVICING REQUIREMENTS AND/OR OPERATING CHARACTERISTICS OF FLUID-EJECTION MECHANISM BASED ON APPROXIMATE OPERATING HUMIDITY AND OPERATING TEMPERATURE
112
STORE SERVICING REQUIREMENTS AND/OR OPERATING CHARACTERISTICS WITHIN FIRMWARE
114

DETERMINING HUMIDITY OF FLUID-EJECTION MECHANISM BASED AT LEAST ON SPITTING RECOVERY LEVEL OF MECHANISM

BACKGROUND

To maintain the image quality of images output by inkjet printers, inkjet-printing mechanisms of the printers, such as their printheads, are occasionally serviced, sometimes unbeknownst to end users. For instance, the nozzles of the printheads may be dry wiped, in which wipers wipe over the nozzles. The nozzles may also be wet wiped, in which the wipers first pick up solvent, such as glycerol or glycol, and then wipe over the nozzles. Other types of servicing are also commonly performed.

To determine the servicing intervals of their inkjet-printing mechanisms, some printers include temperature sensors and humidity sensors. However, humidity sensors in particular can add undue cost to the printers, so that they may not be included in less-expensive inkjet printers. The servicing intervals of such lower-cost printers may therefore be set to cause servicing of the printhead nozzles as if the printers were always operating in worst case environments, performing service often. Such high-frequency service intervals may, however, unduly waste ink and may reduce throughput of the inkjet printers, since servicing can interrupt printing and introduce delay to the output of images printed on media.

SUMMARY

A method of an embodiment of the invention includes determining a spitting recovery level of a fluid-ejection mechanism. A humidity of the fluid-ejection mechanism is then determined, based on at least the spitting recovery level.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

FIG. 1 is a flowchart of a method for adjusting the servicing requirements and/or the operating characteristics of a fluid-ejection mechanism, according to an embodiment of the invention.

DETAILED DESCRIPTION

Figure 2:
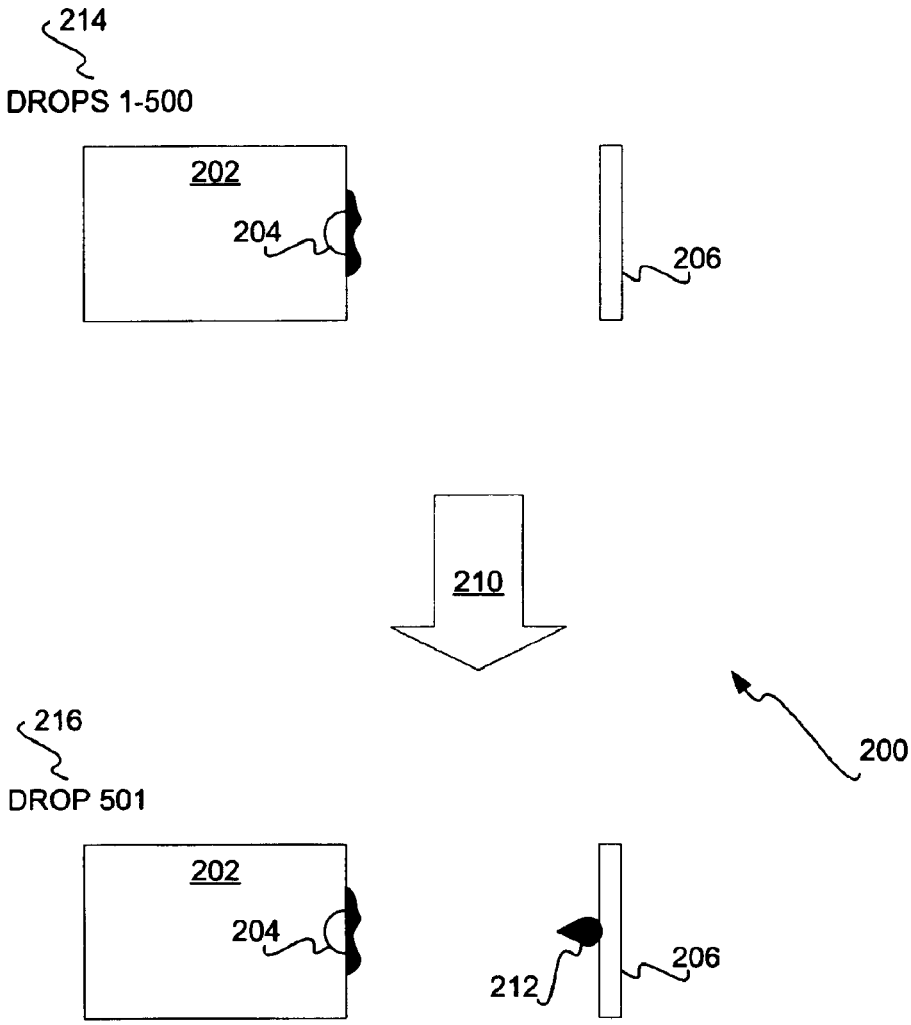
FIG. 2 is a diagram of a scenario depicting how a fluid drop detector can be used to determine the spitting recovery level of a fluid-ejection mechanism, according to an embodiment of the invention.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Servicing Requirements for a Fluid-Ejection Mechanism

The intervals at which inkjet-printing mechanisms of inkjet printers, or more generally fluid-ejection mechanisms of fluid-ejection devices, are serviced usually depend on environmental factors in which the printers operate, such as temperature and humidity. Such environmental factors affect the interaction between how ink dries on the faceplate for the nozzles and how much solvent the wipers pick up during wet wiping. In high-temperature and low-humidity conditions, ink dries quickly on the faceplate, making it more difficult to clean than in high-temperature and high-humidity conditions, because more wet wipes or more frequent wipes are needed. Further, at higher temperatures the ink may also form soft ink "plugs" faster in the orifices of the nozzles, due to higher evaporation rates. The plugs may be easy to clear with a small amount of "spitting," which is the attempted ejection of ink through the plugs. Similarly, in low-temperature and low-humidity conditions, the ink dries faster than in low-temperature and high-humidity conditions. At lower temperature conditions, more spitting may be needed than at higher temperature conditions, because easily removed soft plugs do not form. There may be less evaporation from the nozzles at the low temperature conditions, which leaves some part of the ink present to form a hard plug that is difficult to clear without excessive spitting.

Furthermore, the viscous properties of the solvents that are used for wet wiping, such as glycol or glycerol, can be very sensitive to temperature and humidity. Typically, as the temperature of these solvents increases, the viscosity decreases. Humidity affects the viscous properties, for instance, because the solvents are hydroscopic. Therefore, the greater the water content of the surrounding environment, the lower the viscosity of the solvent. If the viscosity of the solvent is higher than that found in ambient conditions, the wipers pick up less solvent, and less solvent is distributed onto the faceplate for the nozzles. If the viscosity of the solvent is lower than that found in ambient conditions, more solvent will be picked up and distributed onto the faceplate. As a result, it can be easier to clean nozzles in hot and wet environments than in cold and dry environments, due to the amount of solvent that is available to wipe the faceplate. The ability to maintain nozzle health is thus often dependent on how easily the ink can be removed from the orifices of nozzles, on the degree to which the ink on the faceplate for the nozzles has dried, and on the amount of solvent that is made available to clean the faceplate.

Method

FIG. 1 shows a method 100 for adjusting the servicing requirements and/or the operating characteristics of a fluid-ejection mechanism, according to an embodiment of the invention. The fluid-ejection mechanism may be part of a fluid-ejection device. The fluid-ejection mechanism may be an inkjet-printing mechanism, such as an inkjet printhead having a number of nozzles, that is part of an inkjet-printing device, such as an inkjet printer. For instance, an inkjet-printing mechanism may eject ink onto media, for forming images on the media with the ink. The fluid-ejection mechanism may generally be a monochromatic mechanism, ejecting fluid of a single color, such as black, or a color mechanism, ejecting fluids of different colors in accordance with a color model, such as the cyan-magenta-yellow-black (CMYK) color model.

The method 100 may be performed by firmware associated with the fluid-ejection device, which may also be a part of a fluid-ejection device. The firmware is stored on a computer-readable medium. The computer-readable medium may be a magnetic storage medium, a semiconductor, or solid-state, storage medium, and/or an optical medium, such as a hard disk drive, a semiconductor memory, and so on. The method 100 may also be performed by a component of a fluid-ejection device that includes the fluid-ejection mechanism. The component may be a controller, or another type of component of the fluid-ejection device.

The method 100 first waits for a threshold length of time since the servicing requirements and/or operating characteristics of the fluid-ejection mechanism have been previously adjusted (102), or receives user instruction to adjust the servicing requirements and/or the operating characteristics of the fluid-ejection mechanism (104). In the latter case, the user may force the adjustment of the servicing requirements and/or operating characteristics of the fluid-ejection mechanism. For example, there may be a control on the fluid-ejection device of which the mechanism is a part that the user can actuate. Such actuation may be a button, for instance, or an integral part of the device messaging, which may be displayed on a display of the device. The user may also be able to select a force-adjustment command from a set of controls on the fluid-ejection device, or may be able to send such a command from a host computing device, such as a computer, to the fluid-ejection device.

In the former case, the threshold length of time may be measured in days, weeks, or another unit of time. For instance, the threshold length of time may be one week. Measurement may be accomplished by a timing mechanism, such as a clock, that is part of the fluid-ejection device of which the fluid-ejection mechanism is also a part, and that maintains its memory when power is not supplied to the device, such as via a battery-backup mechanism. Alternatively, measurement may be accomplished by examining the time stamps of the print jobs that are received by the fluid-ejection device from a host computing device, such as a computer.

Ultimately a spitting recovery level of the fluid-ejection mechanism is determined (106), which in one embodiment is accomplished by performing 106A, 106B, and 106C of the method 100. The spitting recovery level of the fluid-ejection mechanism is generally and non-restrictively defined as the amount of fluid the fluid-ejection mechanism has to attempt to eject before the mechanism successfully ejects the fluid. For instance, in high-temperature and low-humidity operating environments, fluid on the nozzles of the fluid-ejection mechanism is more likely to quickly dry over the nozzles, such that a smaller amount of fluid may have to be attempted to be ejected by the mechanism before the mechanism actually successfully ejects the fluid. This may be because a soft plug of easily ejected material forms in the nozzle to prevent further evaporation that changes the chemistry of the liquid in the firing chamber.

In high-temperature and high-humidity environments, more fluid may have to be attempted to be ejected before the fluid-ejection mechanism actually successfully ejects the fluid. This may result from insufficient evaporation occurring to allow a soft plug to form. Hence, the chemistry within the firing chamber may change to a degree that requires more drops to be attempted to fire before the chamber actually has the proper ink chemistry.

In one embodiment, determining the spitting recovery level first entails waiting for a threshold length of time during which the fluid-ejection mechanism is idle (106A). For instance, the fluid-ejection device may be powered on, waiting for a print job to be received from a host device. During this time, the fluid-ejection mechanism remains idle, but in a ready state. The threshold length of time during which the fluid-ejection mechanism remains idle may be measured in minutes, hours, or another length of time. For instance, the threshold length of time may be sixty minutes, five-to-twenty minutes, or another length of time. The threshold length of time is preferably that during which the fluid-ejection mechanism is "out-of-cap," which is when the nozzles of the fluid-ejection mechanism, for instance, are open to the surrounding environment, as opposed to when they are at least substantially sealed from the surrounding environment in service station caps, as known within the art.

Next, the fluid-ejection mechanism is caused to attempt to eject fluid drops until the ejection of a fluid drop has been detected (106B). This can entail counting the number of fluid drops that are attempted to be ejected by the fluid-ejection mechanism, until the mechanism successfully ejects a drop of fluid. The detection of the ejection of a fluid drop may be accomplished by using a fluid drop-detecting mechanism, such as an electrostatic fluid drop detector or a fluid optical drop detector, as is more specifically described in a subsequent section of the detailed description. The spitting recovery level is ultimately correlated as the number of fluid drops that were attempted to be ejected until fluid drop ejection has been detected (106C). For instance, the spitting recovery level may be correlated as proportional to the number of fluid drops that were attempted to be ejected. Thus, the spitting recovery level may be greater for a greater number of fluid drops that were attempted to be ejected before fluid drop ejection was successful.

Once the spitting recovery level has been determined, the operating temperature of the fluid-ejection mechanism is optionally measured (108). Temperature measurement may be accomplished by using a temperature-sensing device, such as a thermistor, or another type of temperature-sensing device. The approximate operating humidity of the fluid-ejection mechanism is then determined based on the spitting recovery level and the operating temperature of the mechanism (110). The manner by which the approximate operating humidity is determined in specific embodiments of the invention is described in a subsequent section of the detailed description.

Generally, however, the approximate operating humidity of the fluid-ejection mechanism may be determined based on the spitting recovery level and the operating temperature of the mechanism in a number of different ways. For instance, a look-up table (LUT) may be employed, which indicates the approximate operating humidity for a given spitting recovery level and operating temperature. Alternatively, interpolation may be performed to determine the approximate operating humidity for a given spitting recovery level and operating temperature, using known operating humidities at known spitting recovery levels and operating temperatures. The approximate operating humidity is thus indirectly determined based on the spitting recovery level and the operating temperature of the fluid-ejection mechanism.

The determination of the approximate operating humidity of the fluid-ejection mechanism based on the spitting recovery level and the operating temperature of the mechanism can be dependent on the type of fluid being used within the fluid-ejection mechanism. Certain fluids may have spitting recovery levels that are more or less sensitive to the operating temperature and operating humidity, for instance. Furthermore, the operating humidity may be approximately determined as one of a number of different ranges of operating humidity, based on the operating temperature and spitting recovery level of the mechanism. For example, there may be two, three, four, five, or more such ranges of operating humidity. The number of ranges of operating humidity may itself be dependent on the sensitivity of the spitting recovery level of the fluid to operating temperature and operating humidity.

Once the approximate operating humidity of the fluid-ejection mechanism has been determined, servicing requirements and/or operating characteristics of the fluid-ejection mechanism are adjusted, based on the approximate operating humidity and the operating temperature of the mechanism (112). In one embodiment, this may entail precise alteration of the servicing requirements and/or the operating characteristics of the fluid-ejection mechanism, based on the approximate operating humidity and the operating temperature of the mechanism. In another embodiment, this may entail more general alteration of the servicing requirements and/or the operating characteristics. The manner by which the servicing requirements and/or the operating characteristics are adjusted in a specific embodiment is described in a subsequent section of the detailed description.

For instance, there may be a number of different servicing requirement and/or operating characteristic levels, associated with a like number of different sets of operating humidities and operating temperatures. A first level may be associated with high-humidity and high-temperature environments, a second level may be associated with high-humidity and low-temperature environments, a third level may be associated with low-humidity and low-temperature environments, and a fourth level may be associated with low-humidity and high-temperature environments. A fifth level may then be associated for all other environments, for instance, in which either the humidity, the temperature, or both, are neither high nor low.

Adjusting the servicing requirements can include adjusting the type of servicing that is performed, such as wet wiping of the nozzles of the fluid-ejection mechanism, dry wiping of the nozzles, and so on. For instance, dry wiping may be specified in high-humidity, high-temperature environments, whereas wet wiping may be specified in low-humidity, low-temperature environments. Adjusting the service requirements can also include adjusting the interval at which servicing of the fluid-ejection mechanism is performed. For instance, the length of time between consecutive servicing of the fluid-ejection mechanism may be longer in high-humidity, high-temperature environments, and shorter in low-humidity, low-temperature environments.

Finally, the servicing requirements and/or the operating characteristics of the fluid-ejection mechanism, as have been adjusted, are preferably stored in firmware associated with the fluid-ejection mechanism (114). The firmware may be the firmware of the fluid-ejection device of which the fluid-ejection mechanism is a part. Storing the servicing requirements and/or the operating characteristics within non-volatile firmware allows them to be subsequently looked up in cases where, for instance, the fluid-ejection device of which the fluid-ejection mechanism is a part is turned off. This avoids having to resort to default servicing requirements and/or operating characteristics, or having to immediately adjust the servicing requirements and/or the operating characteristics, when the fluid-ejection device is then turned back on.

Determining Spitting Recovery Level Using Fluid Drop Detector

FIG. 2 shows a scenario 200 as to how a fluid drop detector 206 can be used to determine the spitting recovery level of a fluid-ejection mechanism 202, according to an embodiment of the invention. The fluid-ejection mechanism 202 is illustratively depicted as having a single fluid-ejection nozzle 204, for purposes of descriptive clarity, over which residual fluid has dried. The fluid drop detector 206 may be an electrostatic drop detector hit plate, as is specifically depicted in FIG. 2. Alternatively, the detector 206 may be an optical drop shoot-through detector, or another type of liquid drop detector. The scenario 200 is divided into two parts. The first part 214 corresponds to the fluid-ejection mechanism 202 attempting to eject the first 500 drops via the nozzle 204, leading to the second part 216, as indicated by the arrow 210, and which corresponds to the fluid-ejection mechanism 202 attempting to eject the $501^{st}$ drop via the nozzle 204.

In the first part 214, the residual fluid prevents the nozzle 204 of the fluid-ejection mechanism 202 from actually ejecting the fluid drops for the first 500 tries, such that the fluid drop detector 206 does not register any fluid drops being ejected by the nozzle 204. In the second part 216, the fluid drop attempted to be ejected by the nozzle 204 breaks through the residual fluid, such that in the $501^{st}$ attempt, a fluid drop 212 is ejected and reaches the fluid drop detector 206. Thus, in the scenario 200, the fluid-ejection mechanism 202 has attempted to eject fluid drops 500 times before succeeding with the $501^{st}$ fluid drop ejection attempt. The spitting recovery level of the fluid-ejection mechanism 202 may be correlated as proportional to this number of fluid drop-ejection attempts before a successful attempt at fluid drop ejection occurred.

Determining Approximate Operating Humidity

Figure 3:
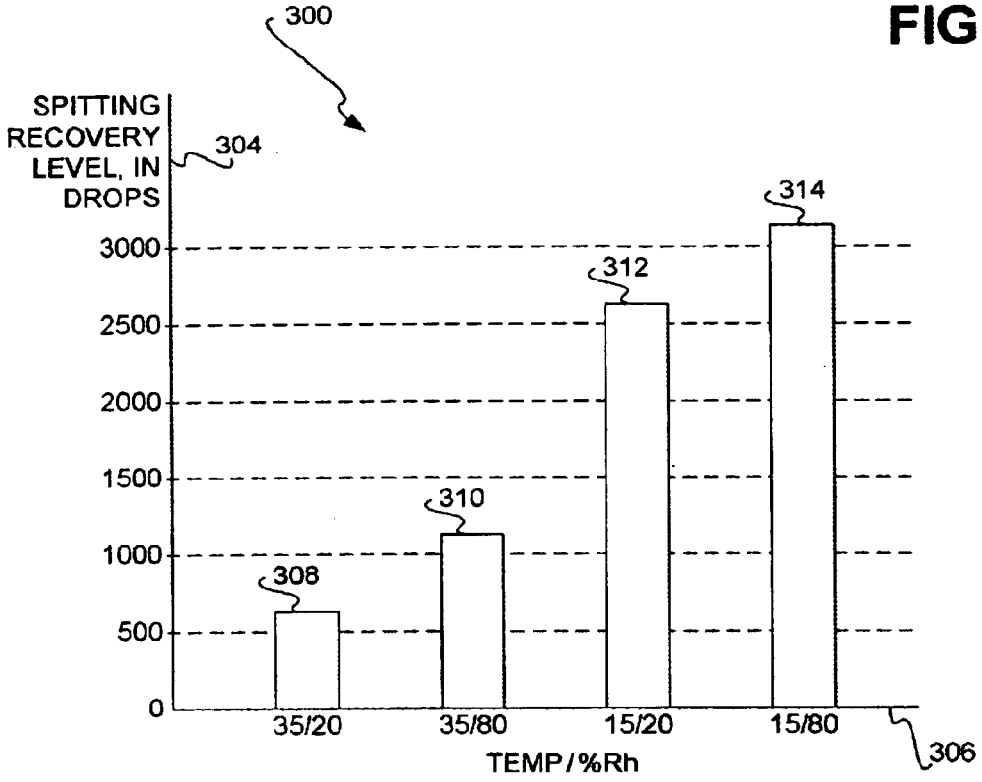
FIG. 3 is a chart depicting how spitting recovery level, operating humidity, and operating temperature of a fluid-ejection mechanism are interrelated, and such that the approximate operating humidity of the mechanism can be interpolated from the mechanism's spitting recovery level and the operating temperature, according to an embodiment of the invention.

FIG. 3 shows a chart 300 that can be used to determine the approximate operating humidity of a fluid-ejection mechanism, based on the operating temperature and the spitting recovery level of the fluid-ejection mechanism, using interpolation, according to an embodiment of the invention. The y-axis 304 of the chart 300 denotes the spitting recovery level as the number of fluid drops attempted to be ejected by the fluid-ejection mechanism until the mechanism has successfully ejected a fluid drop. The x-axis 306 of the chart 300 denotes environmental operating conditions as operating temperature-operating humidity pairs. The operating humidity is indicated as a percentage of relative humidity, whereas the operating temperature is indicated in degrees Celsius (° C.).

The chart 300 depicts the spitting recovery levels for four representative environmental operating conditions. The first bar 308 indicates that at a temperature of 35° C. and at a relative humidity of 20%, the spitting recovery level is known to be greater than 500 drops, whereas the second bar 310 indicates that at 35° C. and at 80% humidity, the spitting recovery level is known to be greater than 1000 drops. The third bar 312 indicates that at a temperature of 15° C. and at a relative humidity of 20%, the spitting recovery level is known to be greater than 2,500 drops, whereas the fourth bar 314 indicates that at 15° C. and at 80% humidity, the spitting recovery level is known to be greater than 3000 drops.

This known data can then be used to interpolate the approximate operating humidity for a given operating temperature and a given spitting recovery level, as can be appreciated by those of ordinary skill within the art. For instance, for a given value of the operating temperature, generally the approximate operating humidity is proportional to the number of fluid drops attempted to be ejected until a fluid drop has successfully been ejected. More bars, representing more known data, can be utilized than the four depicted in FIG. 3 for greater precision in interpolating the approximate operating humidity.

Furthermore, the chart 300 depicts the spitting recovery levels for a particular type of fluid, such as ink, and/or for a particular type of fluid-ejection mechanism. For instance, the chart 300 may depict the spitting recovery level of magenta ink. Magenta ink may be more sensitive to humidity and/or temperature, with respect to its spitting recovery level, than other color inks, such as cyan ink, yellow ink, and black ink. Thus, charts for other color inks comparable to the chart 300 for magenta ink would have bars that differ in height as compared to the bars 308, 310, 312, and 314 of the chart 300. In addition, several inks can be examined, where one ink, for instance, may be sensitive to one humidity-temperature pair, whereas another ink may be sensitive to another humidity-temperature pair. This may be desirable where a given ink is sensitive to all conditions except one, to which another ink is sensitive.

Adjusting Servicing Requirements and/or Operating Characteristics

Figure 4:
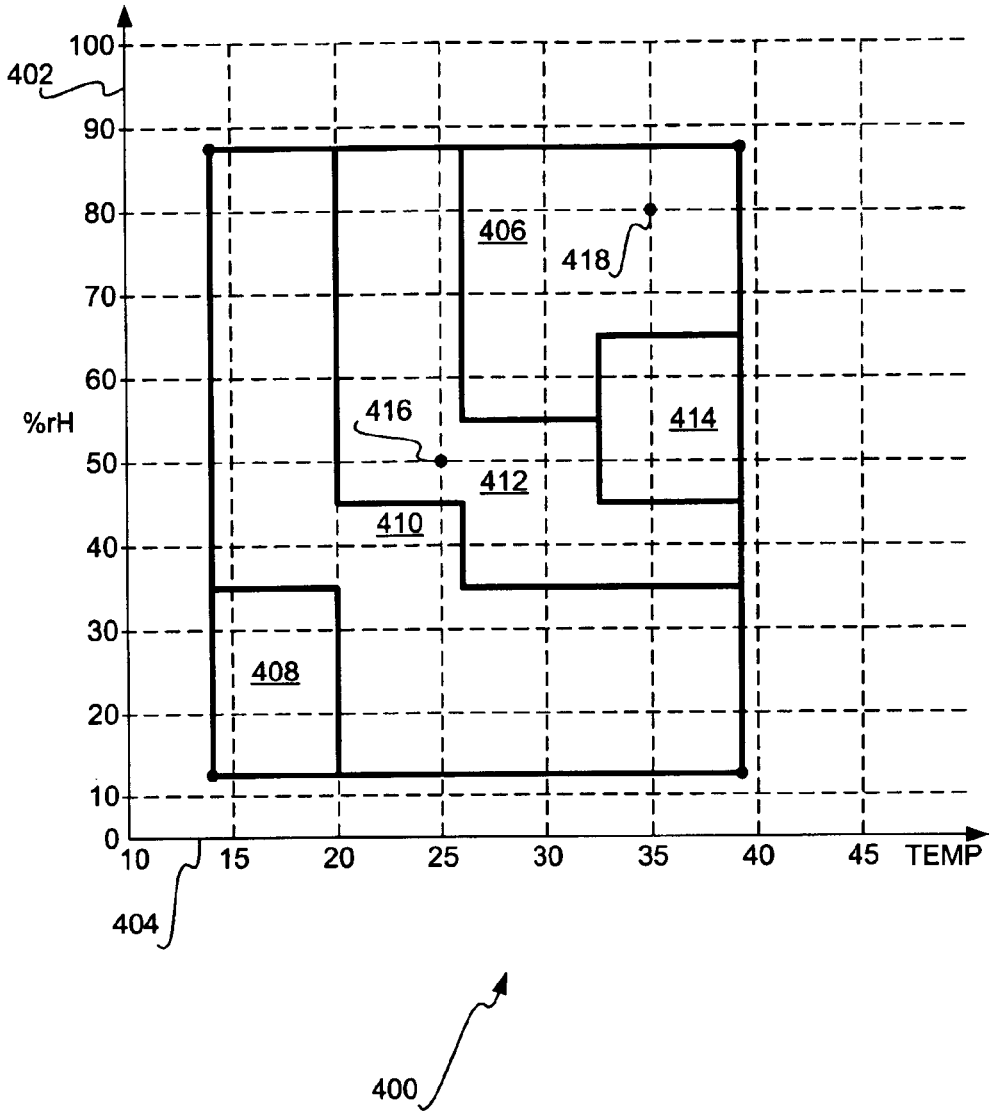
FIG. 4 is a graph that can be used to assign the servicing requirements and/or operating characteristics of a fluid-ejection mechanism to one of five different sets of such values based on the approximate operating humidity and the operating temperature of the mechanism, according to an embodiment of the invention.

FIG. 4 shows a graph 400 that can be used to adjust servicing intervals and/or operating characteristics of a fluid-ejection mechanism, based on the indirectly determined approximate operating humidity and on the measured operating temperature of the mechanism, according to an embodiment of the invention. The y-axis 402 of the graph 400 denotes relative humidity as a percentage, whereas the x-axis 404 of the graph 400 indicates temperature in degrees Celsius (° C.).

The graph 400 has five different areas, 406, 408, 410, 412, and 414, corresponding to five different sets of values to which the servicing requirements and/or operating characteristics of the fluid-ejection mechanism can be assigned. Based on the indirectly determined approximate operating humidity of the mechanism and the operating temperature, a given set of values is selected. For example, if the operating temperature of the fluid-ejection mechanism is measured at 25° C., and the approximate operating humidity of the mechanism is determined as 50%, then the corresponding point 416 lies within the area 412. The servicing requirements and/or operating characteristics of the fluid-ejection mechanism are therefore set to the values associated with the area 412.

As another example, if the operating temperature is measured at 35° C., and the operating humidity is determined as 80%, then the corresponding point 418 lies within the area 406. Therefore, the servicing requirements and/or operating characteristics of the fluid ejection mechanism are set to values associated with the area 406. The values for the servicing requirements associated with the area 406, for instance, may specify a longer duration of time before servicing of the fluid-ejection mechanism is needed, as compared to the duration specified by the values for the servicing requirements associated with the area 412. This may be because the area encompasses higher temperatures and/or higher humidity than does the area 412.

Fluid-Ejection Device

Figure 5:
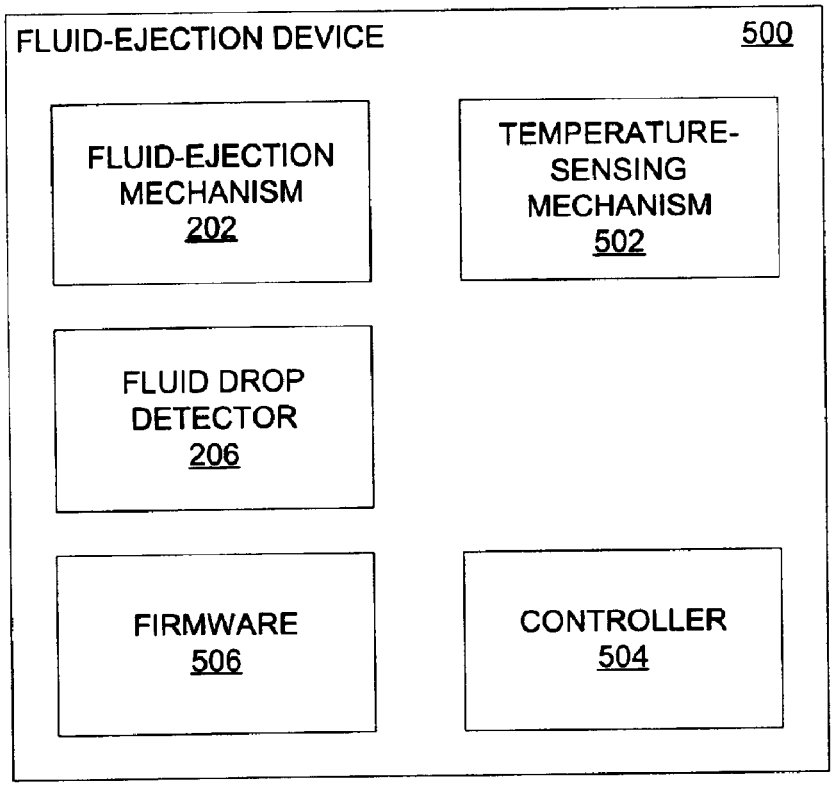
FIG. 5 is a diagram of a fluid-ejection device, according to an embodiment of the invention.

FIG. 5 shows a fluid-ejection device 500, according to an embodiment of the invention. The fluid-ejection device 500 is depicted in FIG. 5 as having the fluid-ejection mechanism 202, the fluid-drop detector 206, a temperature-sensing mechanism 502, a controller 504, and firmware 506. As can be appreciated by those of ordinary skill within the art, the fluid-ejection device 500 may include other components in addition to and/or in lieu of those depicted in FIG. 5. However, the fluid-ejection device 500 preferably but pointedly does not include a humidity sensor, such that the approximate operating humidity of the fluid-ejection mechanism 202 is determined indirectly and preferably without the benefit of such a sensor.

The fluid-ejection mechanism 202 ejects fluid drops. The fluid drops may be ink, for forming images on media, such as paper. As such, the fluid-ejection mechanism 202 may be an inkjet-printing mechanism, such that the fluid-ejection device 500 is an inkjet-printing device. The inkjet-printing device may be an inkjet printer, an inkjet-printing photocopying machine, an inkjet-printing facsimile machine, an inkjet-printing multifunction device (MFD), or another type of inkjet-printing device.

The fluid drop detector 206 indicates successful attempts by the fluid-ejection mechanism 202 to eject fluid drops. The detector 206 can thus be employed to determine the spitting recovery level of the mechanism 202. The controller 504 can be used in this regard to count the number of unsuccessful fluid drop ejection attempts by the mechanism 202 before the fluid drop detector 206 registers a successful attempt at ejecting a fluid drop by the fluid-ejection mechanism 202. The number of attempts counted by the controller 504 may be set as, or provide the basis for, the spitting recovery level of the fluid-ejection mechanism 202. The detector 206 may be an electrostatic detector, an optical detector, or another type of fluid drop detector.

The temperature-sensing mechanism 502 is used to sense, or measure, the operating temperature of the fluid-ejection mechanism 202. The temperature-sensing mechanism 502 may be a thermistor, or another type of temperature-sensing mechanism. The controller 504 may be hardware, software, or a combination of hardware and software, whereas the firmware 506 may be stored on a computer-readable medium. The controller 504 and/or the firmware 506 may perform and/or store computer-readable instructions for performing the method 100 of FIG. 1 that has been described in a preceding section of the detailed description.

More specifically, the controller 504 adjusts the servicing requirements and/or the operating characteristics of the fluid-ejection mechanism 202, based on the measured operating temperature and the indirectly determined approximate operating humidity of the mechanism 202. The controller 504 receives the operating temperature of the mechanism 202 from the temperature-sensing mechanism 502, whereas the controller 504 employs the fluid drop detector 206 to determine the spitting recovery level of the mechanism 202. From the spitting recovery level and the operating temperature, the controller 504 is then able to indirectly approximate the operating humidity of the fluid-ejection mechanism 202. Once the servicing requirements and/or the operating characteristics of the mechanism 202 have been adjusted, the controller 504 may store these adjusted requirements and/or characteristics within the firmware 506.

Conclusion

It is noted that, although specific embodiments have been illustrated and described herein, it will be appreciated by those of ordinary skill in the art that any arrangement is calculated to achieve the same purpose may be substituted for the specific embodiments shown. For instance, whereas at least some embodiments of the invention have been substantially described as determining humidity of a fluid-ejection mechanism based on temperature and spitting recovery level, in other embodiments, the humidity may be determined based solely on spitting recovery level. Similarly, whereas the servicing requirements have been described as being adjusted based on both temperature and humidity, alternatively they may be adjusted based only on humidity. This application is intended to cover any adaptations or variations of the present invention. Therefore, it is manifestly intended that this invention be limited only by the claims and equivalents thereof.

We claim:

1. A method comprising:

determining a spitting recovery level of a fluid-ejection mechanism; and, determining a humidity of the fluid-ejection mechanism based at least on the spitting recovery level.

2. The method of claim 1, further comprising determining a temperature of the fluid-ejection mechanism, wherein determining the humidity of the fluid-ejection mechanism is further based on the temperature.

3. The method of claim 2, wherein determining the temperature of the fluid-ejection mechanism comprises measuring an operating temperature of the fluid-ejection mechanism.

4. The method of claim 2, wherein determining the temperature of the fluid-ejection mechanism comprises utilizing a thermistor within the fluid-ejection mechanism.

5. The method of claim 1, wherein determining the spitting recovery level of the fluid-ejection mechanism comprises:

waiting for a threshold length of time during which the fluid-ejection mechanism has remained idle;

attempting to eject fluid drops until fluid drop ejection has been detected; and, correlating the spitting recovery level as a number of the fluid drops attempted to be ejected until the fluid drop ejection has been detected.

6. The method of claim 5, wherein waiting for the threshold length of time during which the fluid-ejection mechanism has remained idle comprises waiting for the threshold length of time during which the fluid-ejection mechanism has remained idle out of cap.

7. The method of claim 5, wherein attempting to eject the fluid drops until the fluid drop ejection has been detected comprises utilizing a fluid drop detector.

8. The method of claim 5, wherein determining the humidity of the fluid-ejection mechanism comprises correlating the humidity of the fluid-ejection mechanism as proportional to the number of the fluid drops attempted to be ejected until the fluid drop ejection has been detected.

9. The method of claim 1, wherein determining the humidity of the fluid-ejection mechanism comprises determining an approximate operating humidity of the fluid-ejection mechanism.

10. The method of claim 1, wherein determining the humidity of the fluid-ejection mechanism comprises interpolating the humidity of the fluid-ejection mechanism based on the spitting recovery level.

11. The method of claim 1, wherein determining the humidity of the fluid-ejection mechanism comprising determining the humidity of the fluid-ejection mechanism as one of a plurality of humidity ranges based on the spitting recovery level.

12. The method of claim 1, further comprising adjusting at least servicing requirements of die fluid-ejection mechanism based on the determined humidity.

13. The method of claim 12, wherein adjusting at least the servicing requirements of the fluid-ejection mechanism comprises adjusting an interval at which the fluid-ejection mechanism is to be serviced based on the determined humidity.

14. The method of claim 12, wherein adjusting at least the servicing requirements of the fluid-ejection mechanism comprises adjusting a type of servicing for the fluid-ejection mechanism based on the determined humidity.

15. The method of claim 12, wherein adjusting at least the servicing requirements of the fluid-ejection mechanism comprises additionally adjusting operating characteristics of the fluid-ejection mechanism based, on the determined humidity.

16. The method of claim 12, further initially comprising waiting for a threshold length of time since at least the servicing requirements of the fluid-ejection mechanism have been adjusted based on the determined humidity.

17. The method of claim 12, further initially comprising receiving user instruction to adjust at least the servicing requirements of the fluid-ejection mechanism have been adjusted based on the determined humidity.

18. The method of claim 12, further comprising storing at least the servicing requirements of the fluid-ejection mechanism as have been adjusted to firmware associated with the fluid-ejection mechanism.

19. The method of claim 1, wherein the fluid-ejection mechanism is an inkjet-printing mechanism.

20. A fluid-ejection device comprising:

a fluid-ejection mechanism to eject fluid drops;

a fluid drop detector to determine a spitting recovery level of the fluid-ejection mechanism;

a temperature sensor to sense an operating temperature of the fluid-ejection mechanism; and, a controller to adjust at least servicing requirements of the fluid-ejection mechanism based on the spitting recovery level and the operating temperature of the fluid-ejection mechanism, wherein the spitting recovery level is dependent at least on humidity of the fluid-ejection mechanism.

21. The fluid-ejection device of claim 20, wherein the fluid drop detector comprises one of an electrostatic fluid drop detector and an optical fluid drop detector.

22. The fluid-ejection device of claim 20, wherein the controller is to adjust at least the servicing requirements of the fluid-ejection mechanism by selecting one of a plurality of values for at least the servicing requirements based on the operating temperature and the spitting recovery level of the fluid-ejection mechanism.

23. The fluid-ejection device of claim 20, futher comprising firmware in which at least the servicing requirements for the fluid-ejection mechanism are stored.

24. The fluid-ejection device of claim 20, wherein the temperature sensor is a thermistor.

25. The fluid-ejection device of claim 20, wherein the fluid-ejection mechanism is an inkjet-printing mechanism, and the fluid-ejection device is an inkjet-printing device.

26. A fluid-ejection device comprising:

a fluid-ejection mechanism to eject fluid drops;

a fluid drop detector to indicate a successful attempt by the fluid-ejection mechanism to eject the fluid drops; and, means for approximating an operating humidity of the fluid-ejection mechanism based on an operating temperature of the fluid-ejection mechanism and a number of unsuccessful attempts by the fluid-ejection mechanism to eject the fluid drops before the successful attempt by the fluid-ejection mechanism to eject the fluid drops.

27. The fluid-ejection device of claim 26, wherein the means is further for adjusting at least servicing requirements of the fluid-ejection mechanism based on the operating humidity and the operating temperature of the fluid-ejection mechanism.

28. The fluid-ejection device of claim 26, further comprising a temperature-sensing mechanism to sense the operating temperature of the fluid-ejection mechanism.

29. The fluid-ejection device of claim 26, wherein the fluid-ejection mechanism is an inkjet-printing mechanism, and the fluid-ejection device is an inkjet-printing device.

30. A computer-readable medium having firmware stored thereon associated with a fluid-ejection mechanism to perform a method comprising:

attempting to eject fluid drops until fluid drop ejection has been detected;

counting a number of the fluid drops attempted to be ejected until the fluid drop ejection has been detected;

measuring an operating temperature of the fluid-ejection mechanism;

determining an approximate operating humidity of the fluid-ejection mechanism based on the number of the fluid drops counted and the operating temperature measured, and, adjusting at least one of operating characteristics and servicing requirements of the fluid-ejection mechanism based on the approximate operating humidity and the operating temperature of the fluid-ejection mechanism.

31. The computer-readable medium of claim 30, the method further initially comprising waiting for a threshold length of time during which the fluid-ejection mechanism has remained idle.

32. The computer-readable medium of claim 30, the method further initially comprising waiting for a threshold length of time since the at least one of the operating characteristics and the servicing requirements of the fluid-ejection mechanism have been adjusted based on the approximate operating humidity and the operating temperature of the fluid-ejection mechanism.

33. The computer-readable medium of claim 30, the method further comprising storing the at least one of the operating characteristics and the servicing requirements of the fluid-ejection mechanism as have been adjusted.

34. The computer-readable medium of claim 30, wherein the fluid-ejection mechanism and the firmware are part of a fluid-ejection device.

35. The computer-readable medium of claim 34, wherein the fluid-ejection mechanism is an inkjet-printing mechanism and the fluid-ejection device is an inkjet-printing device.

36. A method comprising:

determining a spitting recovery level of a fluid-ejection mechanism using a fluid drop detector; and, adjusting at least servicing requirements of the fluid-ejection mechanism based on the spitting recovery level of the fluid-ejection mechanism, wherein the spitting recovery level is related to a humidity of the fluid-ejection mechanism.

37. The method of claim 36, further comprising determining a temperature of the fluid-ejection mechanism, wherein adjusting at least the servicing requirements of the fluid-ejection mechanism is further based on the temperature of the fluid-ejection mechanism.

38. The method of claim 36, wherein determining the spitting recovery level of the fluid-ejection mechanism comprises:

waiting for a threshold length of time during which the fluid-ejection mechanism has remained idle;

attempting to eject fluid drops until fluid drop ejection has been detected; and, correlating the spitting recovery level as a number of the fluid drops attempted to be ejected until the fluid drop ejection has been detected.

39. The method of claim 36, wherein the fluid-ejection mechanism is an inkjet printing mechanism.

* * * * *

UNITED STATES PATENT AND TRADEMARK OFFICE

CERTIFICATE OF CORRECTION

PATENT NO. : 6,945,625 B2
APPLICATION NO. : 10/615737
DATED : September 20, 2005
INVENTOR(S) : Jeffrey J. Anderson It is certified that error appears in the above-identified patent and that said Letters Patent is hereby corrected as shown below:

Column 10, Claim 12, line 4, delete “die” and insert therefor --the--

Signed and Sealed this

Fifth Day of December, 2006

JON W. DUDAS
*Director of the United States Patent and Trademark Office*